United States Patent [19]

Sowards

[11] 3,953,146

[45] Apr. 27, 1976

[54] APPARATUS FOR TREATING LINT IN AN AUTOMATIC WASHER

[75] Inventor: Brian David Sowards, Benton Harbor, Mich.

[73] Assignee: Whirlpool Corporation, Benton Harbor, Mich.

[22] Filed: Aug. 15, 1974

[21] Appl. No.: 497,770

[52] U.S. Cl. ..... 415/121 B; 415/213 R

[51] Int. Cl.[2] ..... F04D 29/70

[58] Field of Search..... 241/46.02, 46.11, 101 R; 134/115 G; 415/121 B; 68/13 R

[56] References Cited

UNITED STATES PATENTS

| | | | |
|---|---|---|---|
| 1,791,547 | 2/1931 | Yoder | 415/121 B |
| 2,644,403 | 7/1953 | Dawson | 415/121 B |
| 3,060,483 | 10/1962 | Black, Jr. | 415/121 B |
| 3,478,690 | 11/1969 | Helke et al. | 415/121 B |
| 3,560,106 | 2/1971 | Sahlstrom | 415/121 B |

FOREIGN PATENTS OR APPLICATIONS

| | | | |
|---|---|---|---|
| 832,549 | 2/1952 | Germany | 415/121 B |

*Primary Examiner*—Henry F. Raduazo
*Attorney, Agent, or Firm*—Hill, Gross, Simpson, Van Santen, Steadman, Chiara & Simpson

[57] ABSTRACT

A washing machine including a pump which selectively passes washing liquid to a filter or to a drain, the pump having a vaned impeller driven by an impeller shaft, the impeller structure being provided with a collar in circumscribing relation to the shaft, and a pump housing having a tubular portion in closely spaced relation to the periphery of the collar, the tubular portion having a serrated portion cooperating with the collar to shred lint delivered to the space between the collar and the serrated portion.

6 Claims, 6 Drawing Figures

APPARATUS FOR TREATING LINT IN AN AUTOMATIC WASHER

BACKGROUND OF THE INVENTION

1. Field of the Invention

This invention is in the field of lint handling devices for automatic washing machines and makes use of serrated edges which upon rotation of the pump impeller serve to abrade and shred lint tending to build up around the impeller shaft seal and thereby prevent an accumulation of lint pieces which could be harmful to the proper operation of the pump.

2. Description of the Prior Art

In Platt U.S. Pat. No. 3,653,807 issued Apr. 4, 1972 and assigned to the assignee of the present application, there is described a method and apparatus for treating lint in an automatic washing machine wherein a lint bearing liquid is withdrawn from the washing tub, the lint is shredded in the wash liquid, the lint is filtered from the shredded lint bearing wash liquid, the filtrate is pumped back into the tub, the filter is back flushed at predetermined intervals, the lint in the liquid resulting from the back flushing is shredded and ultimately discharged from the machine.

It is known to combine macerating or grinding means into an automatic dish washer as shown in U.S. Pat. Nos. 3,310,243 and 3,370,598. There are also examples in the prior art wherein pumps are provided with cutting means or the like driven on a common shaft with the pump impeller, as for example in U.S. Pat. Nos. 1,192,575; 2,042,641; and 2,306,298. A related disclosure is found in U.S. Pat. No. 2,496,359 which shows a disintegrator or cutting device for insertion in sewer lines. U.S. Pat. No. 3,060,483 describes a cutting arrangement for a textile suction cleaner which employs a cutter to sever yarn, tape or lint to prevent those materials from clogging a machine blower. U.S. Pat. No. 2,143,693 is directed to a protective device for a ship's propeller. This device includes a protective sleeve which carries saw teeth on a cutting edge formed on the outer end portion of the protective sleeve facing the propeller shaft. The purpose of the device is to prevent foreign objects such as a rope becoming enmeshed in the propeller or propeller shaft and bearing assembly which might cause damage to those parts.

SUMMARY OF THE INVENTION

The present invention is directed to a pump assembly for use in an automatic washing machine in which the invention operates specifically in the area of the pump impeller. The buildup of lint around an impeller shaft seal eventually may form a thick mat over the entire impeller. In time, the mat may become so thick and tangled that it actually causes the pump to fail. Such failure may be accelerated when various fabrics such as towels and shag rugs are being washed in the automatic washing machine.

The present invention provides an improved seal barrel in the pump housing assembly which provides a plurality of spaced teeth around its lower edge. This seal barrel cooperates with an upstanding collar or shoulder portion located about the impeller shaft with a minimum clearance being provided between the rotating impeller and the spaced teeth on the seal barrel. In the improved system of the present invention, the belt driven pump impeller is rotated at a high rate of speed, and the lint which tends to accumulate in a mat around the impeller seal adjacent the seal barrel lower edge receives impacting blows from the teeth for each revolution of the impeller, thereby tearing and shredding the lint and preventing an objectionable buildup of lint about the impeller. The rotation of the impeller serves to throw lint outwardly against the teeth on the seal barrel and reduce the lint to a size which can be conveniently handled for discharge.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
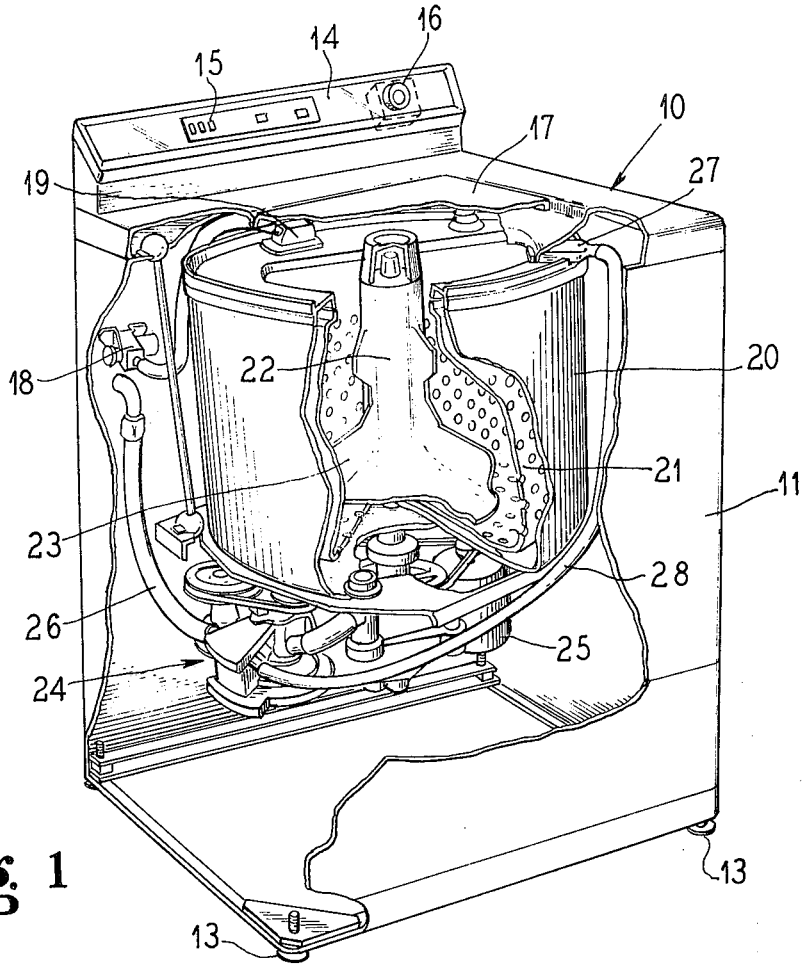
FIG. 1 is a view in perspective of an automatic washing machine, partly broken away, which can employ the improvements of the present invention.

In FIG. 1, reference numeral 10 indicates generally a vertical axis type automatic washing machine including a cabinet 11 which is positioned on the floor at an adjustable elevation by means of threaded legs 13. A console 14 includes a set of push buttons 15 and a dial 16 for selecting various cycles for the machine, and for programming the machine as is well known in devices of this type.

The cabinet 11 is provided with an access door 17 to permit access to the interior of the cabinet. A mixing valve 18 introduces water at a controlled temperature through a water inlet 19 into an imperforate tub 20 in which there is positioned a perforate wash basket 21. Mounted axially of the basket 21 is a vertical axis agitator 22 having agitator vanes 23 extending therefrom for agitating the fabrics during the washing cycle. A pump generally indicated at reference numeral 24 is driven by a motor 25 and delivers wash liquid selectively to a drain through a conduit 26 or to a removable filter 27 through a conduit 28.

Figure 2:
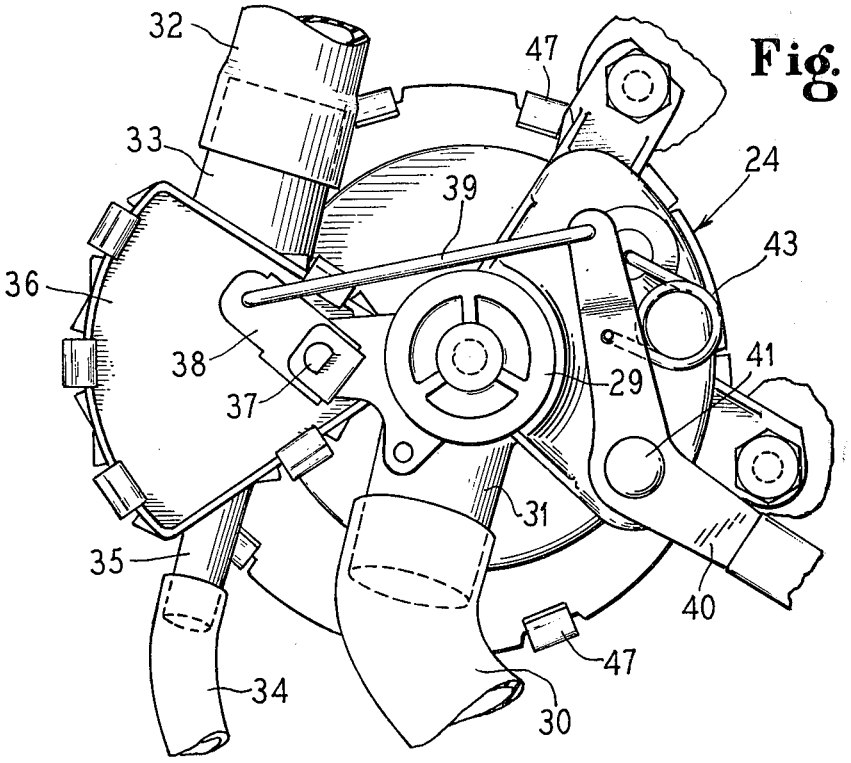
FIG. 2 is a plan view of the entire pump assembly of the invention.
Figure 3:
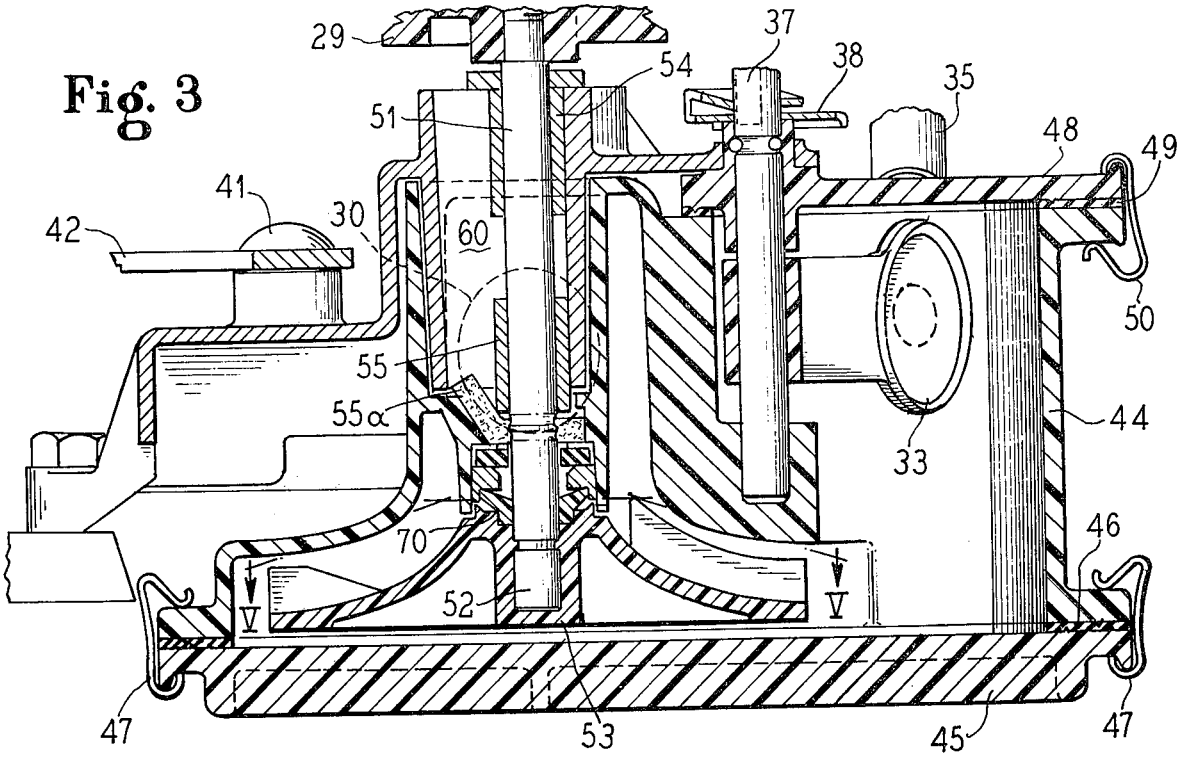
FIG. 3 is a cross-sectional view through the pump assembly illustrating the impeller and housing structure.
Figure 4:
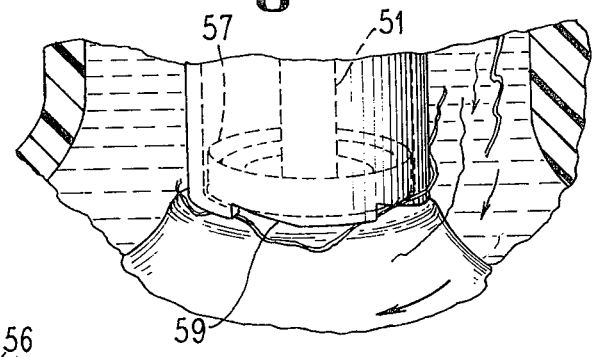
FIG. 4 is a fragmentary cross-sectional view of the lint shredding assembly during operation.

The present invention is particularly centered about the pump assembly 24 which is best illustrated in FIGS. 2 to 6 of the drawings. As best seen in FIGS. 2 and 3, the pump 24 is driven at a substantial angular velocity from the motor 25 through a belt which is trained around a pulley 29. An inlet hose 30 feeds wash liquid into the pump 24 through a fitting 31 and a hose 32, together with a fitting 33 are provided to direct wash water to a suitable drain. A hose 34, together with a fitting 35, is used to direct the wash water to the conduit 28 and thence to the filter 27.

Selective passage of the wash water either to the drain or to the filter is controlled by actuation of a flexible diaphragm contained in a sub-housing 36, and the details of the manner in which the diaphragm is pivoted within the sub-housing 36 do not form part of the present invention, and are well known to those skilled in the art. Suffice it to say that there is an actuating linkage including a shaft 37 about which the flexible diaphragm is pivoted, the shaft 37 being connected to a link 38 and a rod 39 to a bell crank-type lever 40 which is pivoted on a pivot 41. An actuating arm (not shown) which is energized by a solenoid (not shown) moves the bell-type crank lever 40 against the bias provided by a spring 43 to move the flexible diaphragm either into sealing engagement against the fitting 33 or against the fitting 35 and thereby selectively direct the wash water to either the drain or to the filter, respectively.

As best seen in FIG. 3, the housing of the pump 24 includes a central portion 44. A base plate 45 is received in sealing relation with the central portion 44 through a gasket 46 and the pressure of a plurality of spring clips 47. Similarly, a top portion 48 is coupled to the central portion 44 through a gasket 49 and maintained thereagainst by the pressure of a plurality of spring clips 50.

As shown in FIGS. 3 to 6, the pulley 29 carries an impeller shaft 51 which has an end portion 52 imbedded in the impeller 53. A plurality of bearing members 54 and 55 are provided along the axial length of the impeller shaft 51. The pump housing also includes an oil sump 60 which delivers oil directly to the bearings. A wiping element **55*a*** composed of porous material returns oil which has dripped off the bearings back to the sump.

Figure 6:
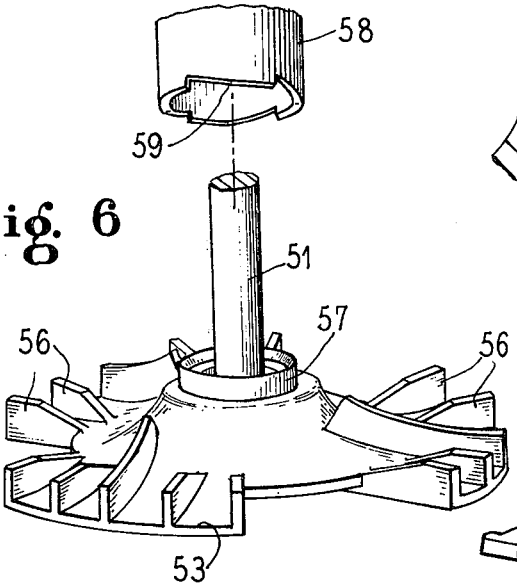
FIG. 6 is an exploded view illustrating the manner in which the impeller and the seal barrel or tube are fitted together to provide the lint shredding assembly shown in FIG. 4.
Figure 5:
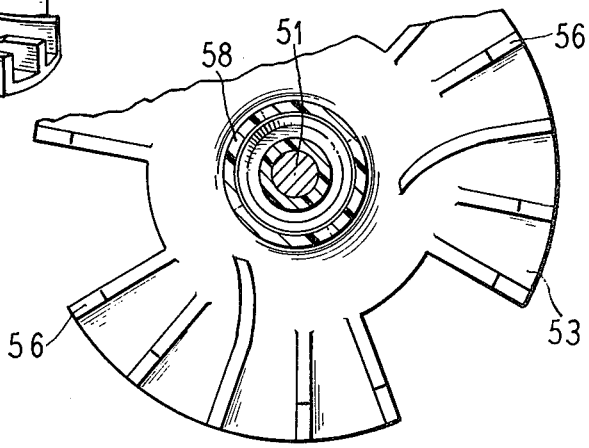
FIG. 5 is a fragmentary cross-sectional view taken substantially along the line V—V of FIG. 3.

As best seen in FIG. 6, the impeller structure consists of a plurality of vanes 56 emanating from a central hub portion which has an integral ring or collar 57 formed thereon. A seal boot 70 is disposed in a zone within a seal barrel 58 concentric to the impeller shaft 51. The collar 57 is arranged to be received in closely spaced relation within the interior of the seal barrel 58 which is integral with the pump housing and which, at its lower end, carries a plurality of serrations such as four equally spaced saw teeth 59.

When the pump is assembled and operating in a washing machine, the impeller is spinning at a high rate of speed. This spinning causes the teeth 59 disposed about the seal boot zone to have a velocity relative to lint buildup in the seal boot zone. Because of the proximity of the collar 57 to the teeth 59, the lint which is tending to build up into the area between the collar and teeth is pushed into the teeth 59 and the relative motion of impeller and teeth will shred and tear the lint away from the ring of lint which may be formed around the impeller seal. Consequently, lint may accumulate around the seal but will not build up past the teeth. The rotation of the impeller thus throws lint outward against the teeth on the seal barrel.

Prior to the present invention, there was a high incidence of pump failure due to buildup of lint of various fabrics, towels, shag rugs and the like on the impeller and its vanes to a point where the pump would lock up and fail. The system of the present invention which effectively inhibits the buildup of lint on the impeller vanes has substantially solved the problem and has reduced pump failures due to excessive lint buildup to an acceptably low level.

It should be evident that various modifications can be made to the described embodiments without departing from the scope of the present invention.

What is claimed is:

1. In a clothes washing machine, a pump for passing lint-bearing wash liquid to drain, said pump having a housing forming a pump chamber with an inlet portion about a bearing member, a centrifugal impeller in said chamber for directing said liquid from said inlet portion to an outlet portion of said pump chamber in said housing, a shaft rotatable in said bearing member and extending to said impeller for rotation therewith through said inlet portion of said pump chamber, wherein:

said impeller has an annular, axially-extending collar about said shaft adjacent and projecting toward said bearing member; and said housing has a tubular portion extending about said shaft and over said collar and carrying a plurality of circumferentially-spaced, axially-facing teeth members closely spaced radially outwardly adjacent said collar, whereby wash liquid carrying lint to said impeller deposits a portion of said lint upon said collar and shaft and said lint deposits are centrifuged outwardly by said collar on the rotation thereof into contact with said teeth, and excess lint is shredded and ejected away from said collar and said bearing member and passed to said drain with said wash liquid.

2. The washing machine pump of claim 1 in which said collar is unitary with said impeller.

3. A pump as defined in claim 1, wherein said collar circumscribes said shaft, and said teeth members on said tubular portion of said housing cooperate with said collar to shred lint delivered to the space between said collar and said teeth.

4. A pump as defined in claim 1, wherein said teeth have a generally saw tooth configuration and said collar throws lint against said teeth during operation of said impeller for shredding.

5. A pump as defined in claim 1 wherein said tubular portion comprises a barrel stationarily carried by said pump housing and having said teeth formed on said barrel so that said impeller rotates relative thereto.

6. A pump as defined in claim 5 wherein a seal barrel is disposed about a seal boot zone concentric to said shaft and wherein said teeth are formed as serrations on the end of said barrel.

* * * * *